United States Patent [19]

Justus

[11] 4,155,177

[45] May 22, 1979

[54] CONDENSATE CONTROL FOR DRYER DRUM

[75] Inventor: Edgar J. Justus, Beloit, Wis.

[73] Assignee: Beloit Corporation, Beloit, Wis.

[21] Appl. No.: 805,598

[22] Filed: Jun. 10, 1977

[51] Int. Cl.[2] ..... F28F 5/02

[52] U.S. Cl. ..... 34/110; 34/124; 34/125; 165/89

[58] Field of Search ..... 34/119, 124, 125, 110; 165/89

[56] References Cited

U.S. PATENT DOCUMENTS

| | | | |
|---|---|---|---|
| 1,453,113 | 4/1923 | Hutchins | 34/125 |
| 3,217,426 | 11/1965 | Barnscheidt et al. | 34/124 X |
| 3,724,094 | 4/1973 | Appel et al. | 34/124 |

FOREIGN PATENT DOCUMENTS

| | | | |
|---|---|---|---|
| 547191 | 3/1932 | Fed. Rep. of Germany | 34/119 |
| 2342318 | 2/1975 | Fed. Rep. of Germany | 34/125 |

*Primary Examiner*—William F. O'Dea
*Assistant Examiner*—Harold Joyce
*Attorney, Agent, or Firm*—Hill, Gross, Simpson, Van Santen, Steadman, Chiara & Simpson

[57] ABSTRACT

A hollow cylindrical dryer drum having an outer surface with a working face for heat drying a traveling paper web with a plurality of axially extending bars on the inner surface of the drum and an annular ring dam positioned against the ends of the bars and spaced from one end of the drum to provide a condensate removal channel between the end of the drum and the ring.

8 Claims, 2 Drawing Figures

CONDENSATE CONTROL FOR DRYER DRUM

BACKGROUND OF THE INVENTION

Figure 1:
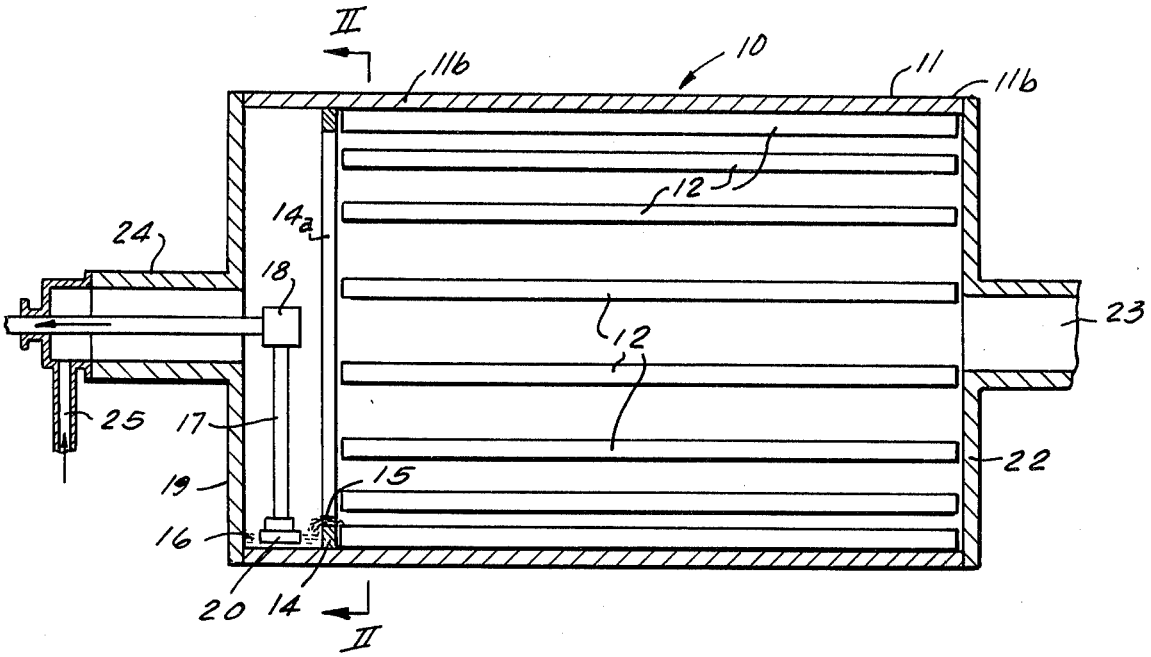

The present invention relates to improvements in rotary drying drums of the type used in paper making machines, and particularly to an improved means of withdrawing the condensate from within the drum.

In a paper making machine, the web is formed and pressed and then passes to a dryer section including a series of dryer drums, each of which has a cylindrical shell with spaced heads and journals for rotatably mounting the shell. Conduits introduce high temperature steam into the shell and means are provided for withdrawing steam condensate from within the shell formed from the cooling of the steam as the traveling paper web is heated in passing over the drum for drying the web.

The steam within the drum must maintain the outer surface of the drum at a temperature for drying the paper web and transmit heat uniformly across the axial width of the drum so that the wide web will be uniformly dried. Water condensate forms within the shell as the steam gives off its heat to the shell. This condensate pools within the drum and at speeds of commercial operation, will tend to rim against the inner surface of the dryer shell forming an insulating barrier preventing heat transmission from the steam to the metal of the shell. To minimize the insulating effect of the layer of condensate rimming within the drum, removal devices have been provided to attempt to remove substantially all of the condensate. Conventionally, suction pipes are positioned within the shell having a removal opening close to the inner surface of the shell, but a layer of condensate will still remain. If the inlet end of the condensate removal tube is too close to the drum, interference will occur, and if is too far from the inner surface of the drum, the layer of condensate will be too thick and the insulating effect will be too great.

Efforts to reduce the insulating effect of the condensate within the drum and to break up the rimming effect have included positioning axially extending bars on the inner surface of the drum as illustrated by U.S. Pat. No. 3,217,426 and by U.S. Pat. No. 3,724,094. Difficulties have still been encountered in removal of the condensate and particularly in removing the condensate in such a manner that the insulating effect of the condensate which remains is uniform across the working face of the dryer drum. Where webs of paper are formed of widths of 16' and more, it is difficult to maintain the condensate at a uniform level for the axial working width of the drum, and if a greater amount of condensate remains at one axial location than another, the insulating effect will be uneven and, therefore, the surface temperature of the drum will be uneven causing uneven drying in the web. This is highly undesirable, and the web must depart from the drying section of the drum to be wound or calendered and be at a uniform moisture content across its entire width.

It is accordingly an object of the present invention to provide an improved dryer drum construction wherein the working face on the outer surface of the drum remains at uniform temperature over its axial length, and the insulating effect of the condensate within is maintained uniform for the length of the drum.

A further object of the invention is to provide an improved structure for removing condensate from within the dryer drum having axially extending bars for creating turbulence in the condensate within the drum, and which is particularly well suited for long drums as are necessary with paper machines which make wide width webs.

Other objects, advantages and features, as well as equivalent structures and method which are intended to be covered hereby, will become more apparent with the teaching of the principles of the invention in connection with the disclosure of the preferred embodiments in the specification, claims and drawings, in which:

DRAWINGS

Figure 2:
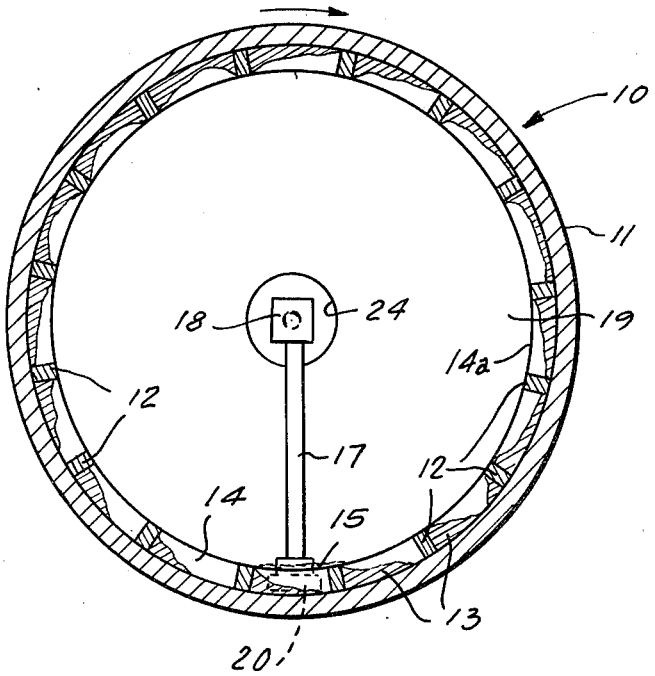

FIG. 1 is a vertical sectional view taken along the axis of a steam dryer drum constructed and operating in accordance with the principles of the present invention; and FIG. 2 is a sectional view taken substantially along line II—II of FIG. 1.

DESCRIPTION

The drawings illustrate a dryer drum 10 which is rotatably mounted and has an outer cylindrical shell 11 with a smooth outer surface. The drying section of a paper making machine generally includes a series of these dryer drums with the web and supporting dryer felts weaving their way in serpentine fashion over a plurality of the drums so that the moisture in the paper is evaporated by the heat from the drum. The drums are heated by steam and introduced into the interior. As the heat energy is imparted to the paper web, the steam condenses and it is necessary to withdraw the condensate to reduce the insulation effect of the condensate, which reduces the heat transmission from the steam to the metal of the drum and to the paper web.

At the ends of the cylindrical shell 11 are heads illustrated at 19 and 22 carried on hubs 23 and 24 which are suitably supported in bearings. The drum may be driven in rotation or driven by contact with the webs and felt.

Steam is introduced into one of the hollow hubs 24 through a steam inlet line 25 and condensate tends to pool at the periphery of the drum. To reduce the insulating effect of the condensate, a plurality of axially extending ribs 12 are arranged around the inner surface of the shell 11. This provides an oscillating movement of the condensate, and the bars 12 cause a surface wave associated with the oscillation of the condensate within the shell. Preferably, the bars are so arranged to maximize the turbulence due to the oscillations of the rim of condensate within the dryer shell to minimize the retardation of heat flow by the condensate, and this can be accomplished by critical spacing of the bars as is disclosed in U.S. Pat. No. 3,724,094. The bars 12 are uniformly spaced and extend axially for the full length of the working face of the drum which extends from a location **11*a* near one end of the drum to a location 11*b* spaced inwardly from the other end of the drum. Thus, the bars are located opposite the entire working face. At the end 11*b* and spaced axially outwardly from the working face, also located within the drum, is an annular ring or dam 14. This dam is so positioned so that it has the radial height of the bars 12 and water tends to flow over the dam 14 as shown at 15 in FIG. 1. The sloshing or turbulence from the bars is illustrated by the cascading of the water shown at 12 in FIG. 6, and this condensate will tend to have a turbulent sloshing motion plus it will tend to flow axially over the dam 14 into the removal reservoir space 16. In the removal space is a siphon tube 17 having an inlet end 20 placed in close proximity to the inner surface of the shell. That is, the inlet end 20 is below the circumferential dam surface 14***a* of the ring. The siphon tube 17 leads to a suction outlet conduit 18 and a suction is continually applied to pump out the condensate from the drum.

Thus, the condensate is wholly removed from the removal reservoir area 16 which does not affect the level or the turbulence of the condensate opposite the working face, which extends from 11*a* to 11*b*. The uniform effect of the condensate with respect to the heat transfer from the steam to the shell 11 is not adversely affected, and it is essential that this uniformity be maintained for the full working length of the drum. The heat transfer effect in the causing of agitation of the condensate by the bars 12 is not disturbed, and the full advantage which is outlined in U.S. Pat. No. 3,724,094, which is incorporated herein by reference, is obtained. The bars 12 are constructed so that they will have the critical height as described, and the dam 14 will be constructed with the same height, and the flow of condensate over the ring dam 14 as indicated at 15 will continue evenly around the circumference of the drum. The level within the annular reservoir space 16 is maintained sufficiently low so that it does not affect the flow 15. While the small amount of concentrate that rims the shell in a reservoir 16 will form an insulating barrier, because this is outside of the working face of the drum, it will not have an effect that causes nonuniformity of heat transfer at the location of the working face. Furthermore, the extension of the drum to provide for the reservoir 16 will reduce heat loss in an axial direction from the working face because of this area being filled with steam.

Thus, it will be seen that I have provided an improved dryer drum construction which meets the objectives and advantages above set forth and provides more uniform drying at high running speeds, obtaining a more uniform paper sheet.

I claim as my invention:

1. A hollow cylindrical dryer drum having an outer surface for heat drying a traveling web comprising in combination:

a steam supply connection for directing steam into the drum;

a condensate removal connection for removing condensate out of the drum;

a plurality of axially extending bars on the inner surface of the drum for imparting turbulence to the condensate within the drum;

an annular ring dam positioned against one end of the bars and spaced from an end of the drum forming a condensate collection channel between said end and said ring dam so that condensate flows over the dam from between said bars and into said channel;

and a condensate removal conduit leading to said removal connection and having an intake end in said channel.

2. A hollow cylindrical dryer drum having an outer surface for heat drying a traveling web constructed in accordance with claim 1 wherein:

said bars are unformly spaced for generating turbulence within said drum so that the condensate sloshes between the bars.

3. A hollow cylindrical dryer drum having an outer surface for heat drying a traveling web constructed in accordance with claim 1 wherein:

the radial height of the ring is equal to the height of said bars.

4. A hollow cylindrical dryer drum having an outer surface of heat drying a traveling web constructed in accordance with claim 1 wherein:

the axial width of the channel is less than the circumferential distance between bars.

5. A hollow cylindrical dryer drum having an outer surface of heat drying a traveling web constructed in accordance with claim 1 wherein:

the circumferential area of the channel is less than the circumferential area between adjacent bars.

6. A hollow cylindrical dryer drum having an outer surface of heat drying a traveling web constructed in accordance with claim 1 wherein:

the dryer drum has an axial working face on its outer surface of a length less than the drum and the bars extend for the length of said working face and said channel is positioned axially from the location of said working face.

7. The method of removing condensate from the interior of a hollow cylindrical dryer drum having an outer surface for heat drying a traveling web and having a plurality of axially extending bars against the inner surface of the drum which comprises spacing one end of the bars from the end of the drum, positioning an annular ring against the inner surface of the drum adjacent with the end of the bars to provide a condensate channel between the end of the drum and the ring and causing condensate to splash over the bars and flow over the ring, and removing condensate from the channel.

8. A method for removing condensate from the interior of a hollow cylindrical dryer drum having an outer surface for heat drying a traveling web and having a plurality of axially extending bars against the inner surface of the drum in accordance with claim 7 and limiting the working face of the drum to an area no greater than the length of the bars so that the condensate removal channel is outside of the working face.

* * * * *